US009030132B2

(12) United States Patent
Fong

(10) Patent No.: US 9,030,132 B2
(45) Date of Patent: May 12, 2015

(54) SYSTEM FOR REMOTE CONTROL THROUGH COMPUTING CLOUD

(71) Applicant: FONGSHEK TECHNOLOGY LIMITED, Hong Kong (HK)

(72) Inventor: Ming Fong, Hong Kong (HK)

(73) Assignee: FONGSHEK TECHNOLOGY LIMITED, Hong Kong (HK)

( * ) Notice: Subject to any disclaimer, the term of this patent is extended or adjusted under 35 U.S.C. 154(b) by 325 days.

(21) Appl. No.: 13/759,070

(22) Filed: Feb. 5, 2013

(65) Prior Publication Data

US 2013/0229132 A1 Sep. 5, 2013

Related U.S. Application Data

(60) Provisional application No. 61/606,953, filed on Mar. 5, 2012.

(51) Int. Cl.

| | |
|---|---|
| ***G08C 19/22*** | (2006.01) |
| ***G08C 19/00*** | (2006.01) |
| ***H05B 33/08*** | (2006.01) |
| ***H05B 37/02*** | (2006.01) |

(52) U.S. Cl.

CPC ..... *G08C 19/00* (2013.01); *H05B 33/0803* (2013.01); *H05B 37/0254* (2013.01); *H05B 37/029* (2013.01); *G08C 2201/93* (2013.01)

(58) Field of Classification Search

USPC ..... 315/312, 316–318; 340/212.1, 12.15, 340/12.16, 12.23, 12.24, 12.25, 12.28, 340/12.29

See application file for complete search history.

*Primary Examiner* — An Luu

(57) ABSTRACT

A system for remote control includes a user device configured to run an application that receives a user input; a remote device including a controller and a controlled device; and a computing cloud being connected to the user device and the remote device through the Internet and configured to convert the user input received at the user device to a command. The controller is configured to receive and execute the command and thereby control the controlled device accordingly. The application is a non-customized application. The controlled device includes a plurality of cascadable LED cubes.

20 Claims, 20 Drawing Sheets

SYSTEM FOR REMOTE CONTROL THROUGH COMPUTING CLOUD

CROSS-REFERENCE TO RELATED APPLICATIONS

This application claims the benefit of U.S. Provisional Patent Application No. 61/606,953 filed on Mar. 5, 2012; the contents of which is hereby incorporated by reference.

FIELD OF THE PATENT APPLICATION

The present patent application generally relates to remote control technologies and more specifically to a system for remote control through a computing cloud.

BACKGROUND

Remote control of devices at home with a mobile device has been realized in recent years. Typically, there are two mechanisms to achieve it. One is to use a specifically customized application to talk to a computing cloud and the cloud talks to a home controller so as to control the home devices. Another is to use off-the-shelf applications to talk to the home controller and the home controller talks to the home devices. However, it is often desired to have a safer, cheaper, and more convenient system to realize the remote control.

SUMMARY

The present patent application is directed to a system for remote control. In one aspect, the system includes a user device configured to run an application that receives a user input; a remote device including a controller and a controlled device; and a computing cloud being connected to the user device and the remote device through the Internet and configured to convert the user input received at the user device to a command. The controller is configured to receive and execute the command and thereby control the controlled device accordingly. The application is a non-customized application. The controlled device includes a plurality of cascadable LED cubes.

The computing cloud may include a database configured for storing the user's configuration of the controlled device. The computing cloud may further include a computing service configured for generating the command and transmitting the command to the controller. The computing cloud may further include a set of configuration tools configured for allowing the user to configure the behavior of the controlled device in occurrence of an event.

The remote device may further include a gateway configured to enable the communication between the controller and the computing cloud. The controller may include a global master controller being connected to the gateway and a plurality of local master controllers being connected to the global master controller. A cascadable LED cube may be connected to each local master controller, the LED cube including a slave controller and a LED matrix attached to the slave controller.

The LED matrix may include a plurality of LED nodes, each LED node including a LED chip and a LED capsule. The LED capsule may be a housing that accommodates the LED chip. The LED capsule may include a left capsule and a right capsule. The LED capsule may be integrated with the LED chip through a molding process.

The left capsule may include a first mechanical feature for making a z-axis connection, a second mechanical feature for holding LED leads, a third mechanical feature for holding the right and left capsules together, and a fourth mechanical feature for making a x or y axis connection.

The right capsule may include a first mechanical feature for making a z-axis connection, an electrical connection area, a second mechanical feature for holding LED leads, a third mechanical feature for holding the right and left capsules together, and a fourth mechanical feature for making a x or y axis connection.

The slave controller may be configured to take command from the local master controller and thereby control the LED matrix. The slave controller may contain a unique physical ID and at least one logical ID, the logical ID being dynamically assigned during an initialization process.

The slave controller may include a current sensor. The slave controller may be configured to determine the configuration of the LED matrix by the readings of the current sensor during an individual LED scanning routine.

The slave controller may further include a neighbor explorer IO configured to indicate the presence of the slave controller and to detect the presence of neighboring controllers.

The system may further include a plurality of additional remote devices. All the remote devices are synchronized with a common clock, and the GPS information of all the remote devices are sent to computing cloud. The slave controller and the LED matrix may be shaped into models of atoms and bonds.

In another aspect, the present patent application provides a system for remote control including a user device configured to run an application that receives an input; a remote device including a controller and a controlled device; and a computing cloud being connected to the user device and the remote device through the Internet and configured to convert the user input received at the user device to a command. The controller is configured to receive and execute the command and thereby control the controlled device accordingly. The application is a non-customized application.

The computing cloud may include a database that stores the protocol for the controller to control the controlled device and the input may be given by a user or a sensor.

In yet another aspect, the present patent application provides a system for remote control including a user device configured to run an application that receives a user input; a remote device including a controller and a controlled device; and a computing cloud being connected to the user device and the remote device through the Internet and configured to convert the user input received at the user device to a command. The controller is configured to receive and execute the command and thereby control the controlled device accordingly. The application is a non-customized application. The controlled device is a sensor.

The controller may be configured to send the data output of the sensor to the computing cloud.

BRIEF DESCRIPTIONS OF THE DRAWINGS

DETAILED DESCRIPTION

Reference will now be made in detail to a preferred embodiment of the system for remote control disclosed in the present patent application, examples of which are also provided in the following description. Exemplary embodiments of the system for remote control disclosed in the present patent application are described in detail, although it will be apparent to those skilled in the relevant art that some features that are not particularly important to an understanding of the system for remote control may not be shown for the sake of clarity.

Furthermore, it should be understood that the system for remote control disclosed in the present patent application is not limited to the precise embodiments described below and that various changes and modifications thereof may be effected by one skilled in the art without departing from the spirit or scope of the protection. For example, elements and/or features of different illustrative embodiments may be combined with each other and/or substituted for each other within the scope of this disclosure.

Figure 1:
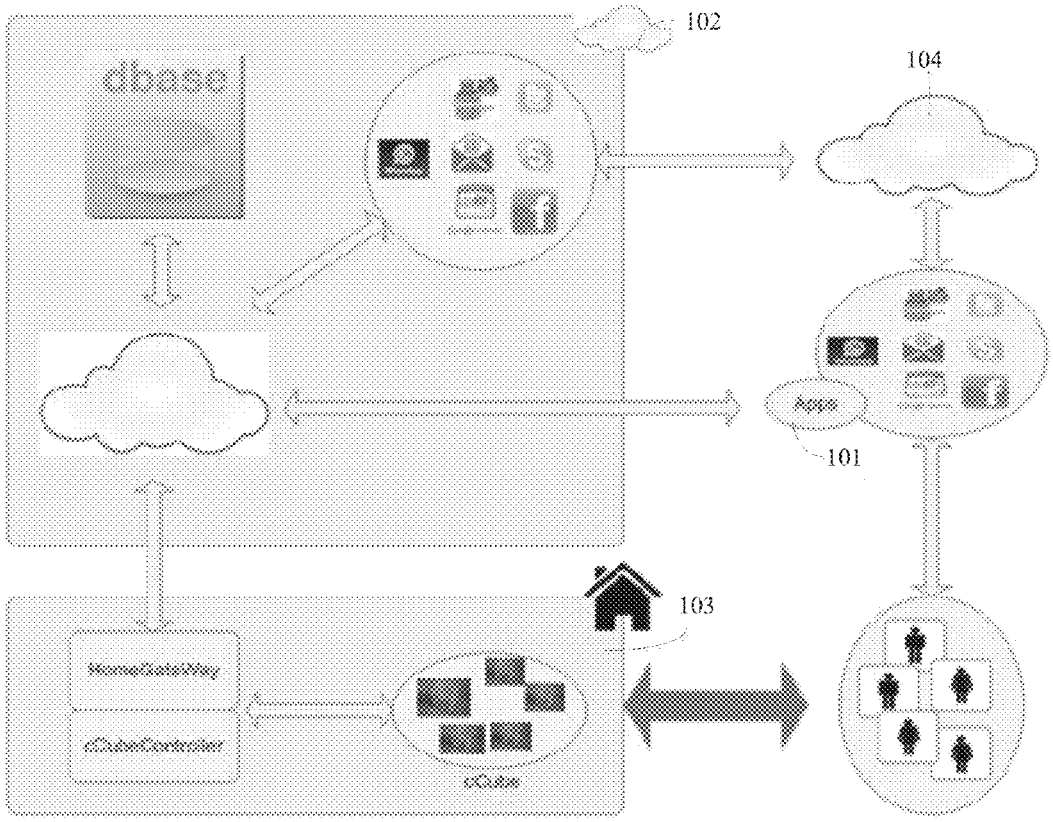
FIG. 1 illustrates a system for remotely controlling a cascadable LED cube according to an embodiment of the present patent application.

FIG. 1 illustrates a system for remotely controlling a cascadable LED cube according to an embodiment of the present patent application. Referring to FIG. 1, the system includes applications 101 running at a user device such as a PC, a smartphone, a tablet, and so on, a computing cloud 102, a home device unit 103 and third party cloud services and applications 104. The home device unit (also referred to as the "remote device") 103 includes a home gateway, a cCube controller, and a cCube (a cascadable LED cube which will be described in more detail hereafter). The cloud 102 is a computing service connected to the Internet and configured to convert the user's input from various communication platforms to control the cCube via the home gateway. The home gateway is an Internet connected device installed at home, which is configured to send and receive messages from the cloud 102 as well as to control the cCube attached to it via the cCube controller. The cCube controller is configured to take command from the home gateway to control the cCube. The 3rd party cloud service is a computing service that already exists in the market, which enables the user to communicate with other users.

In this embodiment, instead of using a specifically customized user application, the system is configured to interface to the most popular communication platforms available such as Skype, Twitter, MSN, Email, and etc. Since there are no perfect applications that can meet everyone's need, the best application is the user's most favorite application. Hence in this embodiment, the user does not need to learn how to use another specifically customized application to operate the system.

In another embodiment, the system may also include dedicated applications, which can be a web based application or a native application running at the user's device. These dedicated applications are for the user to do more complicated configurations of the behavior of the cCube.

Figure 2:
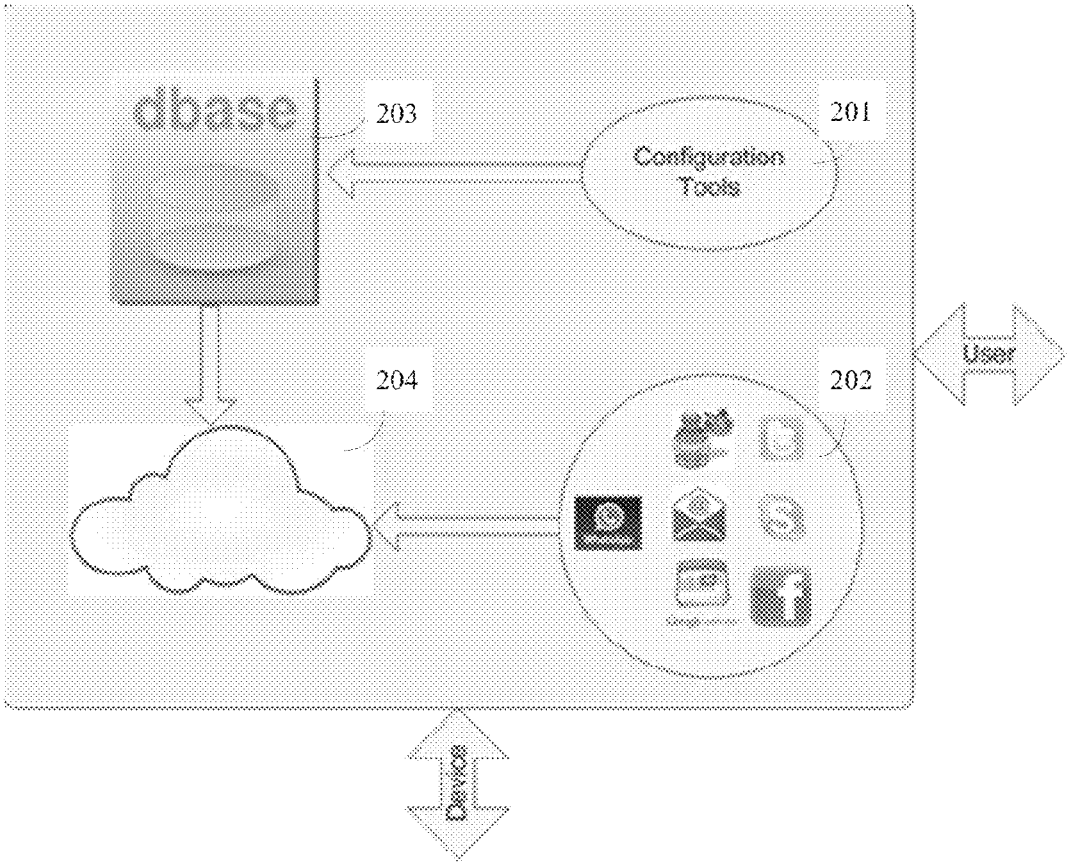
FIG. 2 illustrates the cloud in the system depicted in FIG. 1.

The cloud 102, as illustrated in FIG. 2, is a computing service connected to the Internet, which takes the user's input and then control the cCube installed at home. The cloud 102 includes a set of configuration tools 201 that allows the user to configure the behavior of the cCube in occurrence of an event, an interface 202 that accepts the command from the user via any popular communication platform, such as Skype, Twitter, Email, MSN and etc., a database 203 that stores the user's configuration with respected to his cCube installed at home, and a computing service 204 configured to generate a command based on the user's input and transmit the command to the cCube controller (which will be described in detail hereafter) via a predefined protocol so as to control the cCube.

Figure 3:
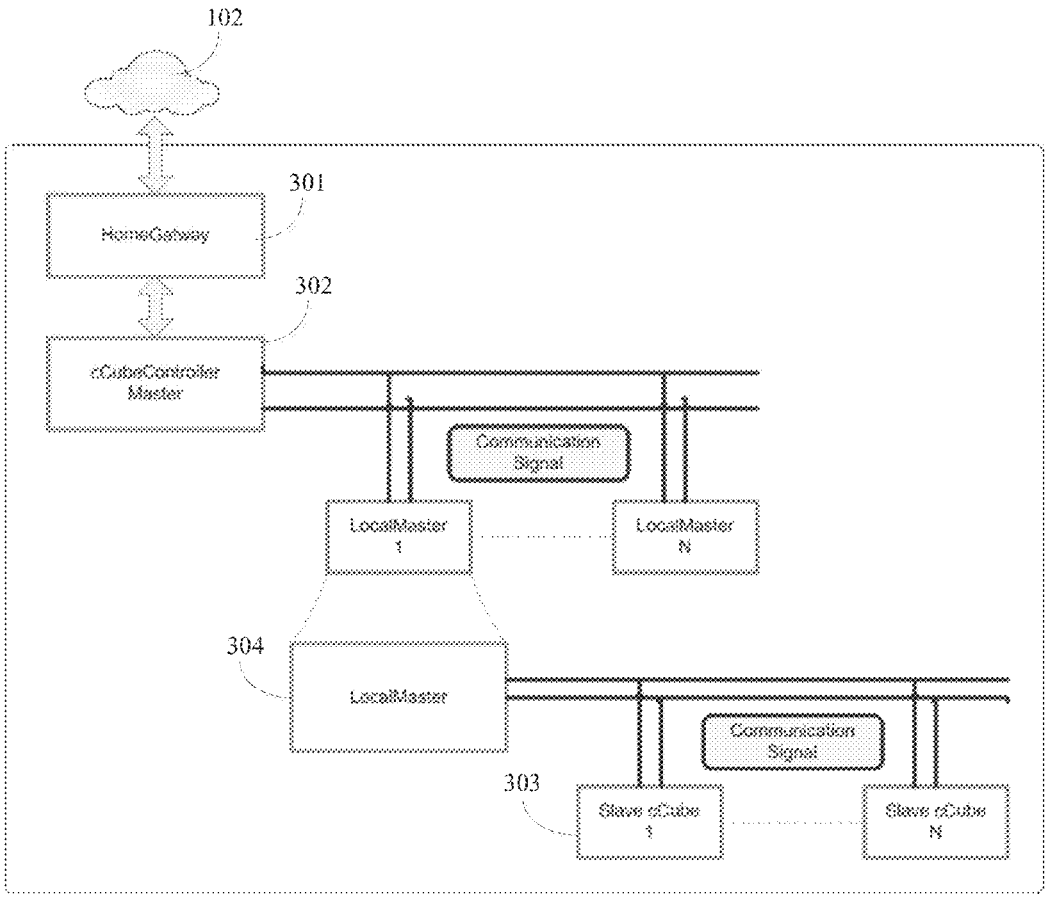
FIG. 3 illustrates the home device unit 103 in the system depicted in FIG. 1.

FIG. 3 illustrates the home device unit 103 in the system depicted in FIG. 1. Referring to FIG. 3, the home gateway 301 is configured to enable the communication between the cCube controller (also referred to as the global master controller) 302 and the cloud 102. The cCube controller 302 is configured to execute the low level commands to control the cCube 303. The cCube 303 is a cascadable LED cube, which includes an array of LED cubes.

Figure 4A:
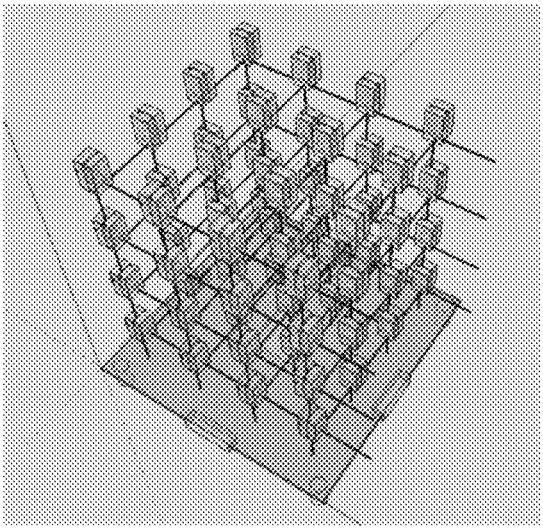
FIG. 4A is a perspective view of a slave cCube as depicted in FIG. 3.
Figure 4B:
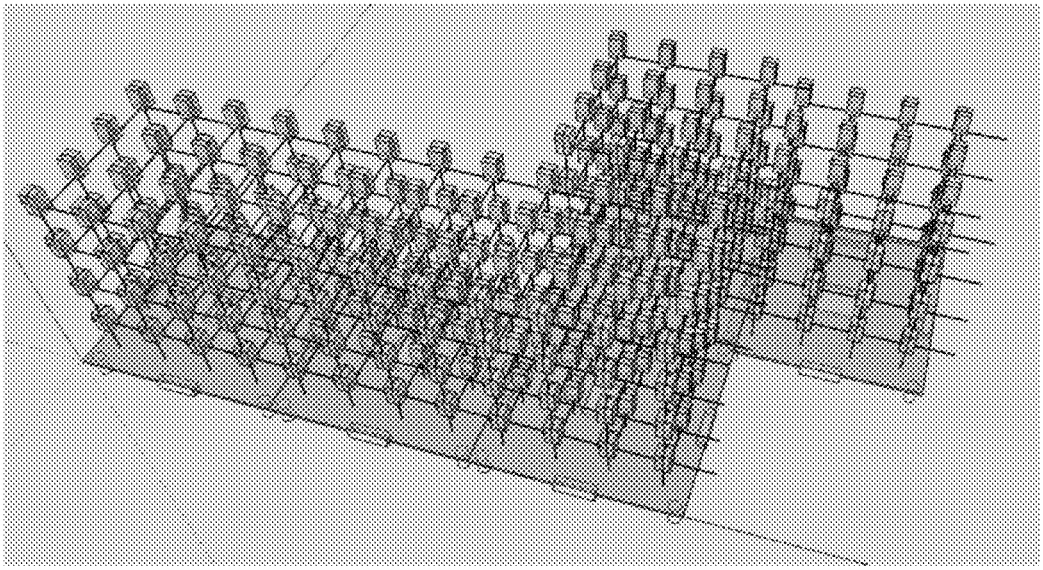
FIG. 4B is a perspective view of a cCube array that includes a plurality of cCubes.

FIG. 4A is a perspective view of a slave cCube as depicted in FIG. 3. FIG. 4B is a perspective view of a cCube array that includes a plurality of cCubes. Referring to FIG. 3, FIG. 4A and FIG. 4B, the slave cCube 303 is a slave device that is connected to the local master controller (LocalMaster 304 in FIG. 3). The slave cCube 303 can be cascaded to form a bigger cCube array. In other words, the cCube array is formed by a plurality of 3D LED cubes being cascaded.

Figure 5:
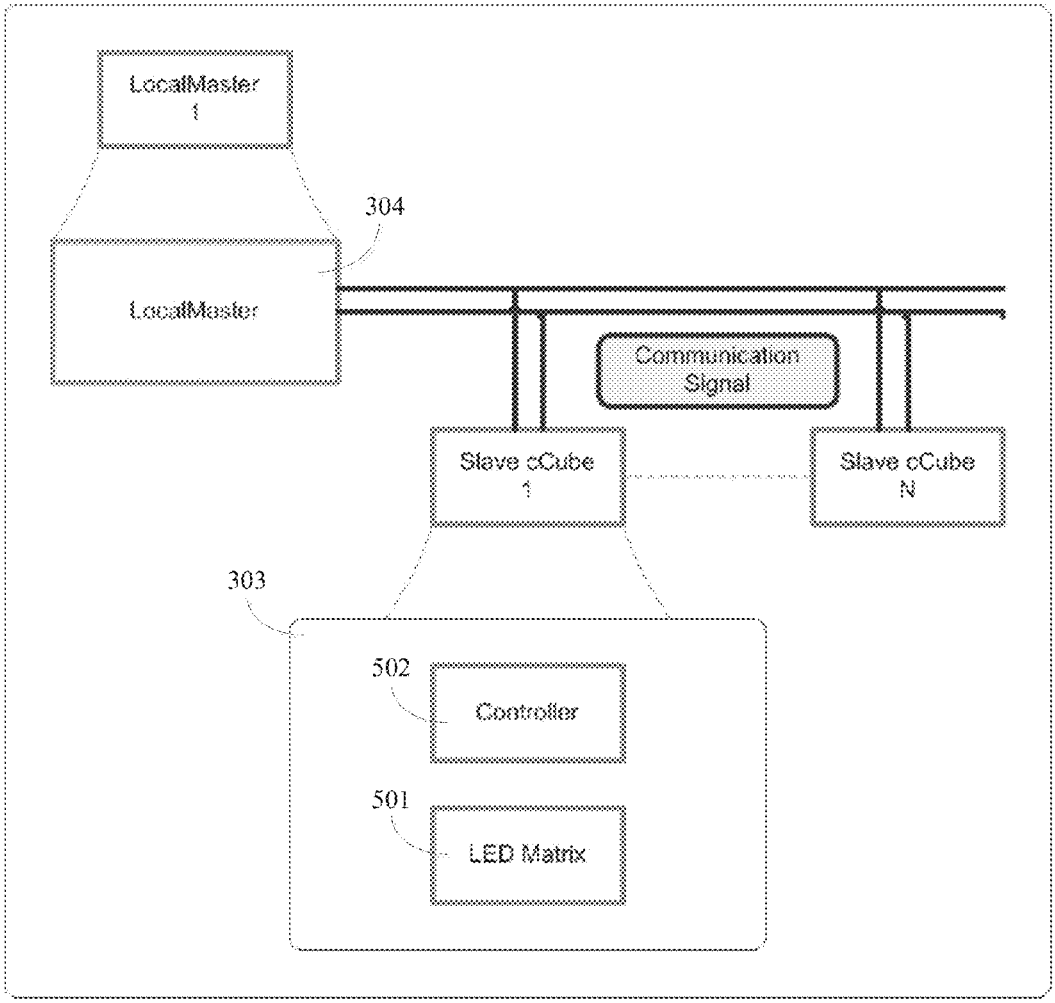
FIG. 5 illustrates the components of the slave cCube depicted in FIG. 3.

FIG. 5 illustrates the components of the slave cCube depicted in FIG. 3. The Slave cCube is the basic building block for the cCube array. Referring to FIG. 5, the slave cCube 303 includes a 3D LED matrix 501 constructed in a matrix structure, a driver PCBA (controller) 502 which controls the individual ON/OFF of each LED in the matrix; and a communication module (not shown in FIG. 5), which is connected to the local master controller 304 and configured for sending and receiving messages/configurations from the cloud 102 (in FIG. 3). The LED matrix 501 is formed by an array of LED chips and LED capsules. The slave controller 502 is configured to take command from a master controller to control the individual On/Off of each LED node within the local LED matrix.

Figure 6:
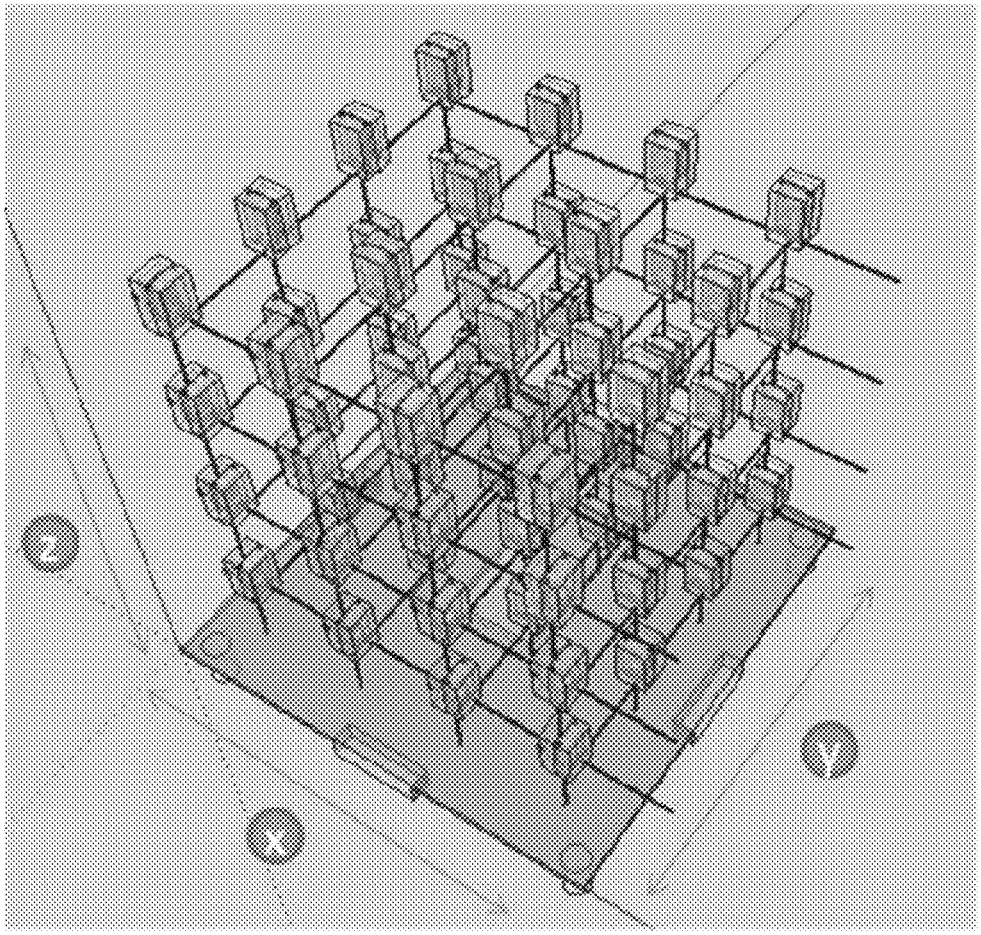
FIG. 6 illustrates the structure of a LED matrix.

FIG. 6 illustrates the structure of a LED matrix. Referring to FIG. 6, The LED matrix is a 3D matrix (x, y, z). (x,y) forms the base matrix. z is the number of layers. In this embodiment, the matrix is 4×4×4. The matrix can grow by installing more layers of LEDs on the z-axis or cascading additional LED matrixes at the x or the y directions. The 4×4 base matrix can be reduced by uninstalling the appropriate LEDs to form any 2D matrix from 1×1 to 4×4. So a system of arbitrary (x by y by z) matrix can be constructed by multiple base LED matrixes.

Figure 7A:
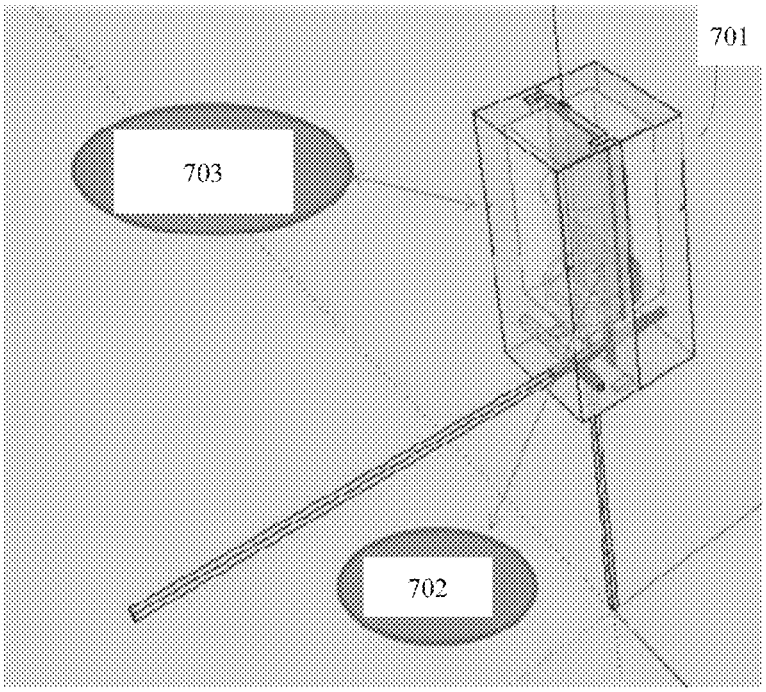
FIG. 7A is a perspective view of a LED node.
Figure 7B:
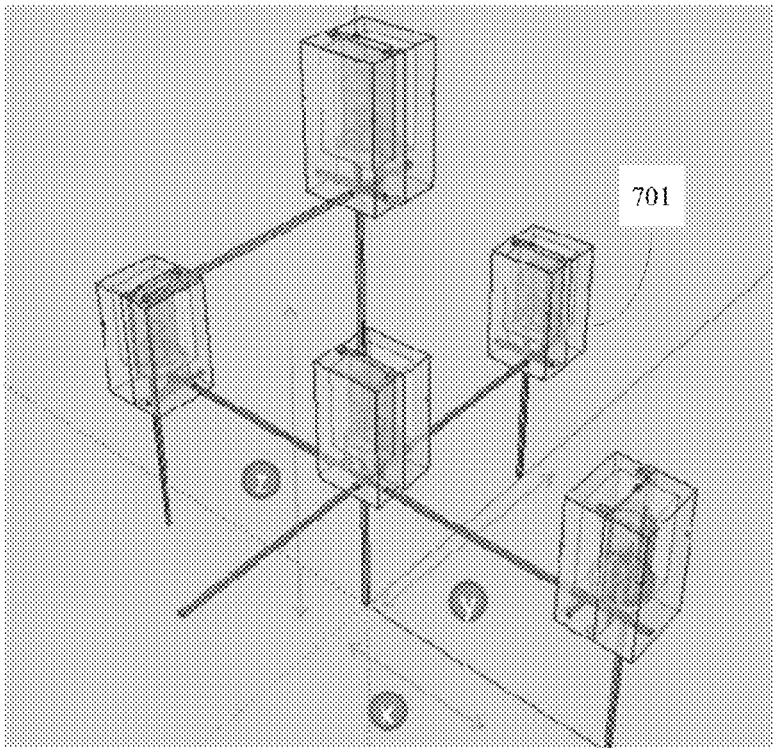
FIG. 7B is a perspective view of a plurality of LED nodes being connected.

The basic element to form the LED matrix 501 is the LED node. FIG. 7A is a perspective view of a LED node. FIG. 7B is a perspective view of a plurality of LED nodes being connected. Referring to FIG. 7A and FIG. 7B, each LED node 701 is formed by a LED chip 702 and a LED capsule 703. The LED capsule 703 encapsulates the LED chip 702 into a module and provides mechanical and electrical features for the LED node 701 in x, y, and z directions, which enables constructing the LED cube without soldering.

Figure 8:
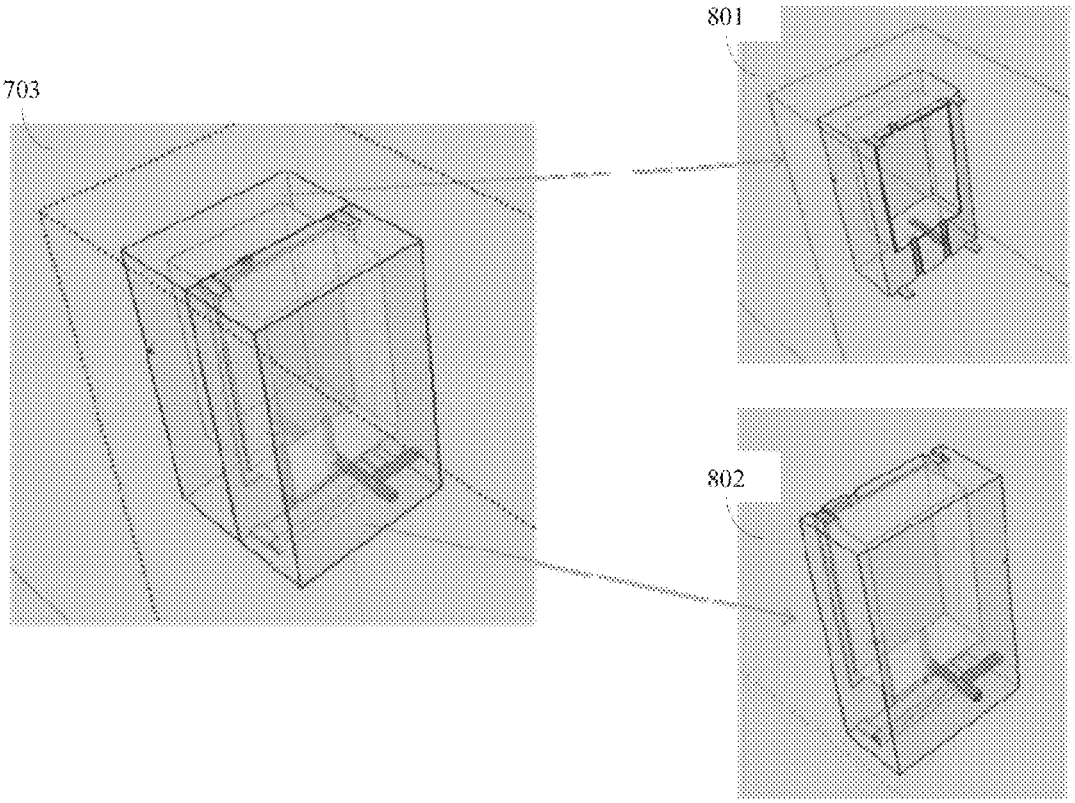
FIG. 8 is a perspective and partial magnified view of the LED capsule.

FIG. 8 is a perspective and partial magnified view of the LED capsule. Referring to FIG. 8, the LED capsule 703 is a transparent or semi-transparent housing that accommodates the LED chip. The LED capsule 703 includes a left capsule 801 and a right capsule 802.

Figure 9A:
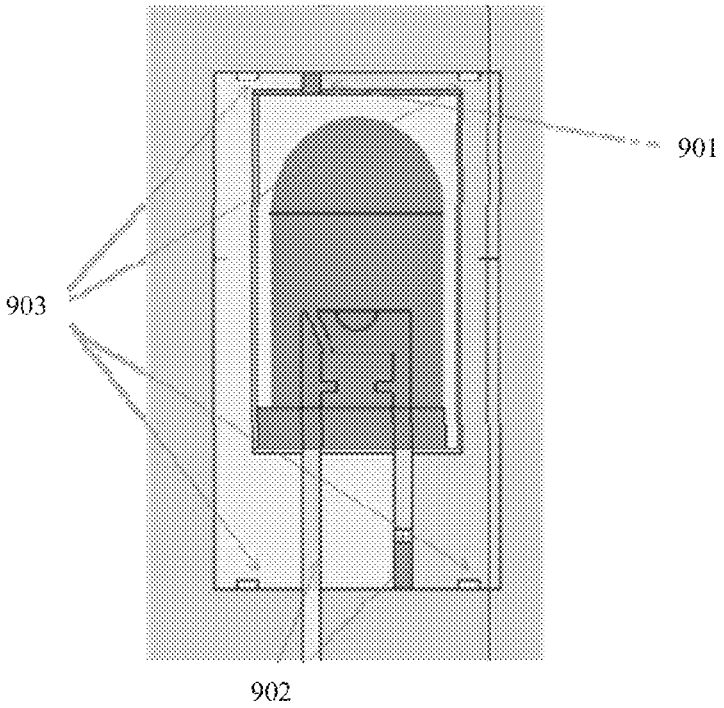
FIG. 9A is a front view of the left capsule depicted in FIG. 8.
Figure 9B:
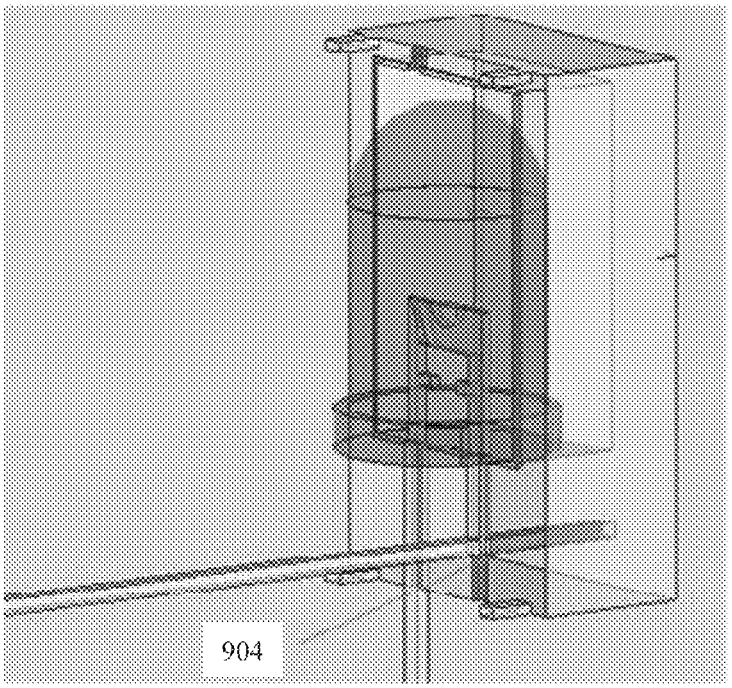
FIG. 9B is a perspective view of the left capsule depicted in FIG. 9A.

FIG. 9A is a front view of the left capsule depicted in FIG. 8. FIG. 9B is a perspective view of the left capsule depicted in FIG. 9A. Referring to FIG. 9A and FIG. 9B, the left capsule includes a first mechanical feature 901 for making the z-axis connection, a second mechanical feature 902 for holding the LED leads, a third mechanical feature 903 for holding the right and left capsules together, and a fourth mechanical feature 904 for making the x or y axis connection.

Figure 10A:
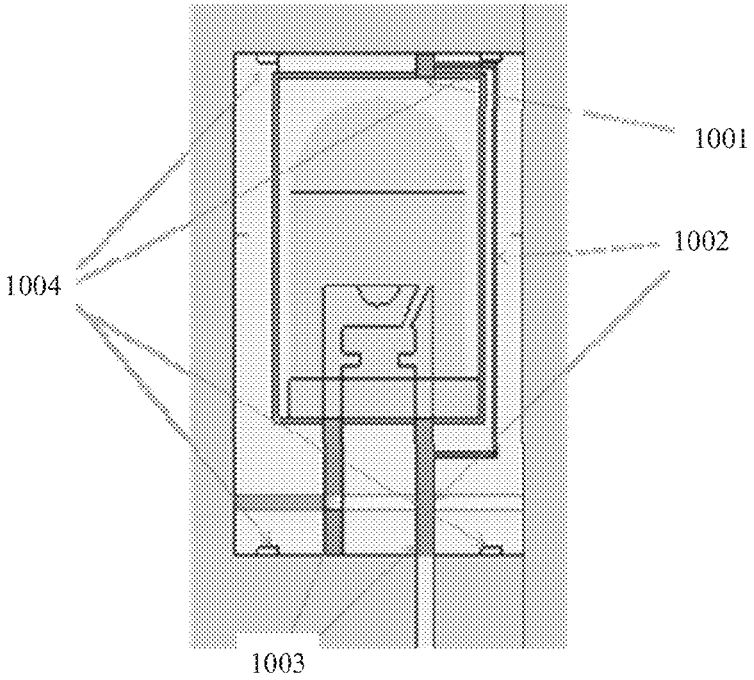
FIG. 10A is a front view of the right capsule depicted in FIG. 8.
Figure 10B:
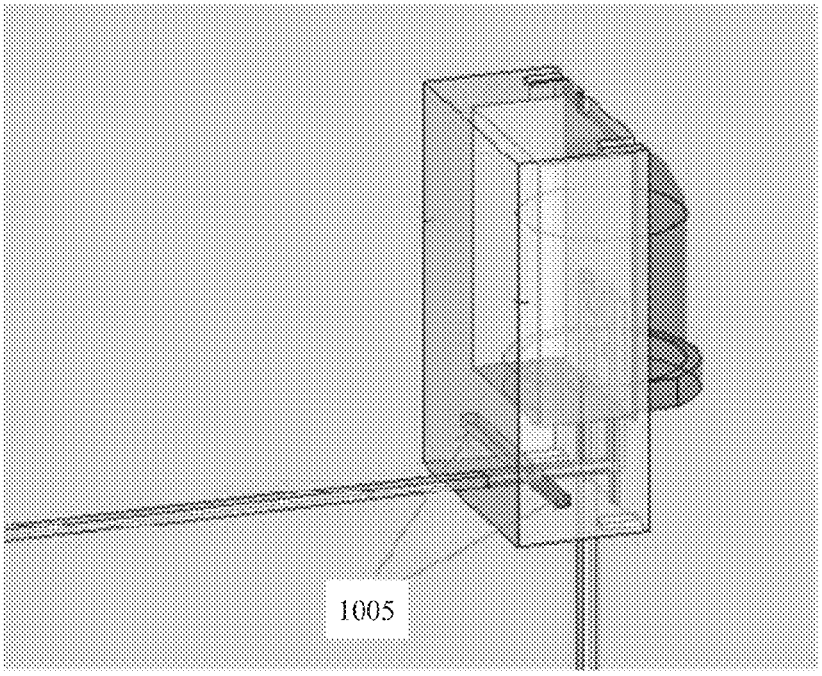
FIG. 10B is a perspective view of the right capsule depicted in FIG. 10A.

FIG. 10A is a front view of the right capsule depicted in FIG. 8. FIG. 10B is a perspective view of the right capsule depicted in FIG. 10A. Referring to FIG. 10A and FIG. 10B, the right capsule includes a first mechanical feature 1001 for making the z-axis connection, an electrical connection area 1002, a second mechanical feature 1003 for holding the LED leads, a third mechanical feature 1004 for holding the right and left capsules together, and a fourth mechanical feature 1005 for making the x or y axis connection.

It is understood that in another embodiment, the LED node, which includes the LED chip, the left capsule, and the right capsule, can also be made directly through a molding process. In other words, the LED capsule is integrated with the LED chip through a molding process.

Figure 11:
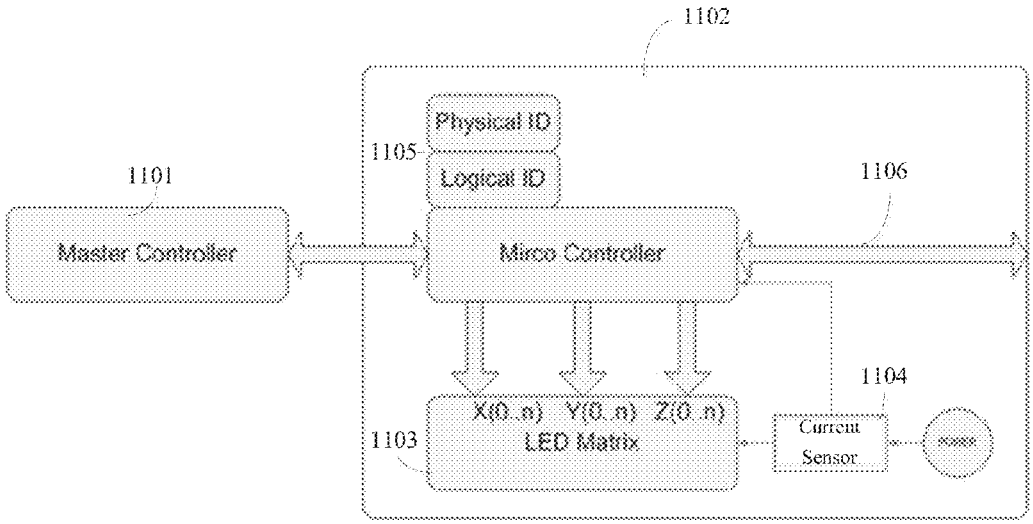
FIG. 11 illustrates the structure of the slave controller depicted in FIG. 5.

FIG. 11 illustrates the structure of the slave controller 502 depicted in FIG. 5. The salve controller is integrated to a controller board 1102, which is a PCBA (PCB with micro-controller and LED driver). The controller board 1102 is configured to take command from the master controller 1101 (the local master controller 304 in FIG. 5) to control the individual On/Off of each LED node within the local LED matrix 1103. The controller board 1102 contains a unique physical ID 1105 which is given in the factory and one or multiple logical IDs 1105, which are dynamically assigned during the initialization process, so that the master controller 1101 can deliver whatever LED patterns to the dedicated slave controller based on the physical ID or logical ID.

Since the LEDs attached to the slave controller can be individually turned on and off, by the readings of the current sensor 1104 during an individual LED scanning routine, the slave controller is configured to determine the configuration of the attached LED matrix. The controller board 1102 further includes a Neighbor Explorer IO configured to indicate the presence of the slave controller and to detect the presence of neighboring controllers, which will be described in more detail hereafter.

Figure 12:
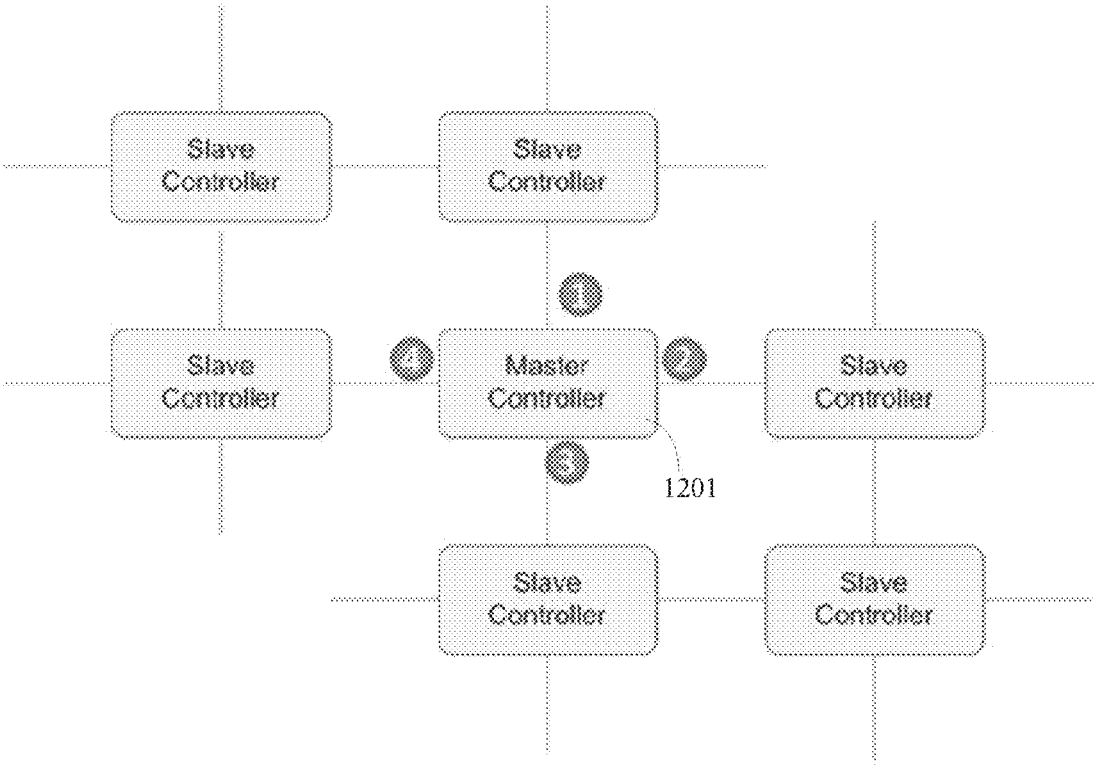
FIG. 12 illustrates the working of the slave controller in exploring the neighbor configuration.

FIG. 12 illustrates the working of the slave controller in exploring the neighbor configuration. Referring to FIG. 12, assuming each controller PCB has four interfaces connected with its neighbor controllers and each interface has one electrical connection connected to the master controller 1201. The exploring process includes:

Step 1: the master controller 1201 sending a command to all slave controllers to configure the Neighbor Explorer IO to INPUT with weak pull up;

Step 2: setting the master controller's Neighbor Explorer IO 1 to OUTPUT LOW;

Step 3: sending a command to ALL slave controllers to send their physical IDs to the master controller 1201 if the slave controller detects the Neighbor Explorer IO as LOW;

Step 4: repeating the steps 2 to 3 with Neighbor Explorer IO 2, 3, and 4;

Step 5: repeating the steps 2 to 4 with the Detected Neighbor Controller until all the neighbor controllers have been found.

This Neighbor Exploring Scheme can be applied on any number of interfaces. N interfaces need N IO pins connected to the master controller.

Figure 13:
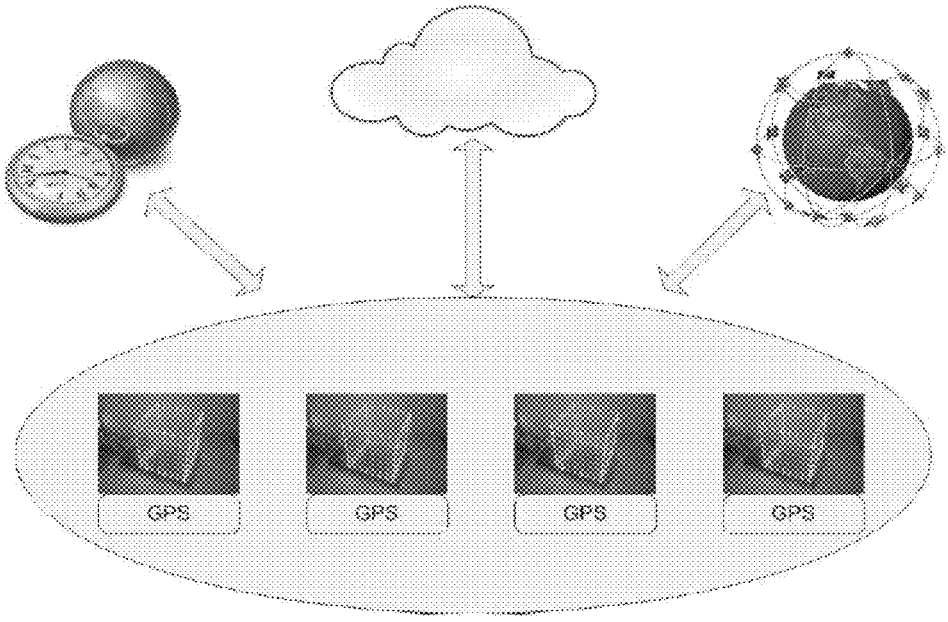
FIG. 13 illustrates a giant cCube according to another embodiment of the present patent application.

FIG. 13 illustrates a giant cCube according to another embodiment of the present patent application. Assuming all the cCubes are synchronized with a common clock (using the network time protocol) and each cCube has the GPS information sent to the Cloud. The Cloud knows the exact location of each cCube, and then the Cloud can link all the neighbor cCube together to form a giant cCube and display any given pattern on this giant cCube.

Figure 14:
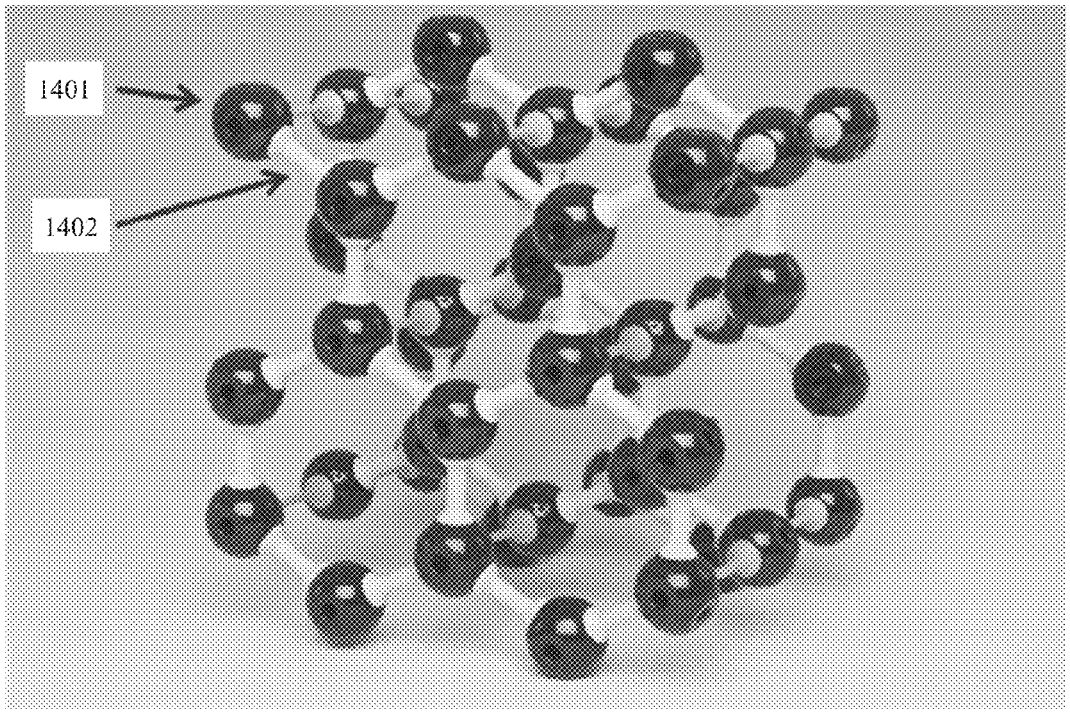
FIG. 14 illustrates an exemplary molecular model set.

Molecular model set is a very common educational tool and toy for showing simple, as well as complex molecular structures. FIG. 14 illustrates an exemplary molecular model set. Referring to FIG. 14, the molecular model set includes atoms 1401 and bonds 1402 between the atoms 1401.

Figure 15:
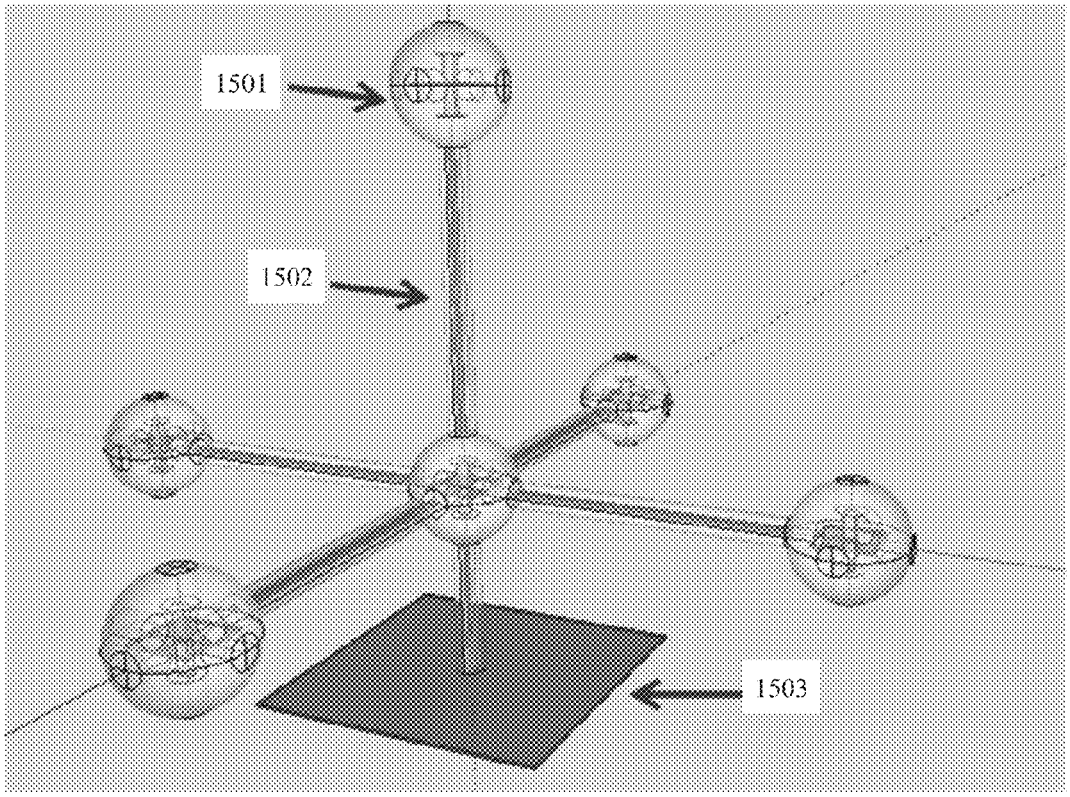
FIG. 15 illustrates an interactive molecular model set according to another embodiment of the present patent application.

FIG. 15 illustrates an interactive molecular model set according to another embodiment of the present patent application. Referring to FIG. 15, in this model, each atom 1501 is an aforementioned LED with a slave controller in an atom appearance. Each bond 1502 is an aforementioned LED with a slave controller in a bond appearance. The master controller 1503 is configured to scan the connections between the bonds and the atoms and control the LEDs in the atoms and the bonds. The master controller 1503 can be a self-contained device with a user interface and a display. The master controller 1503 can also be connected to a PC or the Cloud with the applications running on the PC or a mobile device, which controls the model and interacts with the user.

Figure 16:
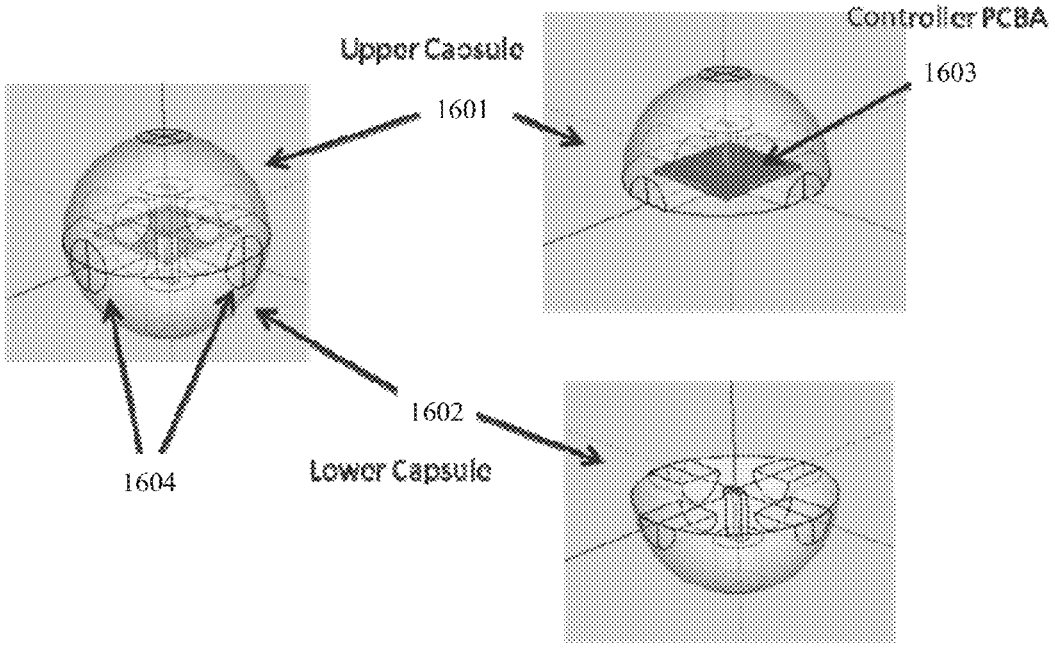
FIG. 16 illustrates the structure of an atom in the interactive molecular model set depicted in FIG. 15.

FIG. 16 illustrates the structure of an atom in the interactive molecular model set depicted in FIG. 15. Referring to FIG. 16, the atom includes an upper capsule 1601, a lower capsule 1602, a controller PCBA 1603, and a bond interface 1604. The atom can have one or multiple bond interfaces. In this embodiment, the atom has 6 bond interfaces. Two kinds of atoms may exist in this system: active atoms which have micro-controllers and LEDs so that the user can input to the controller PCBA; and passive atoms which only provide electrical and mechanical connections to the bonds.

Figure 17:
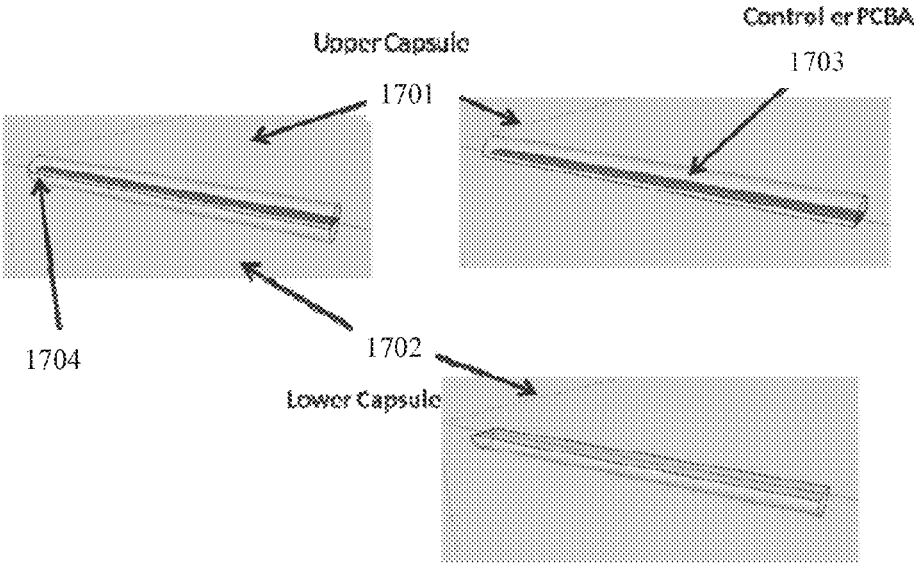
FIG. 17 illustrates the structure of a bond in the interactive molecular model set depicted in FIG. 15.

FIG. 17 illustrates the structure of a bond in the interactive molecular model set depicted in FIG. 15. Referring to FIG. 17, the bond includes an upper capsule 1701, a lower Capsule 1702, a controller PCBA 1703, and an atom interface 1704. The bond can have one or multiple atom interfaces. In this embodiment, the bond has 2 atom interfaces. Two kinds of bonds may exist in the system: active bonds which have micro-controllers and LEDs so that the user can input to the Controller PCBA; and passive bonds which only provide electrical and mechanical connections to the atoms.

Figure 18:
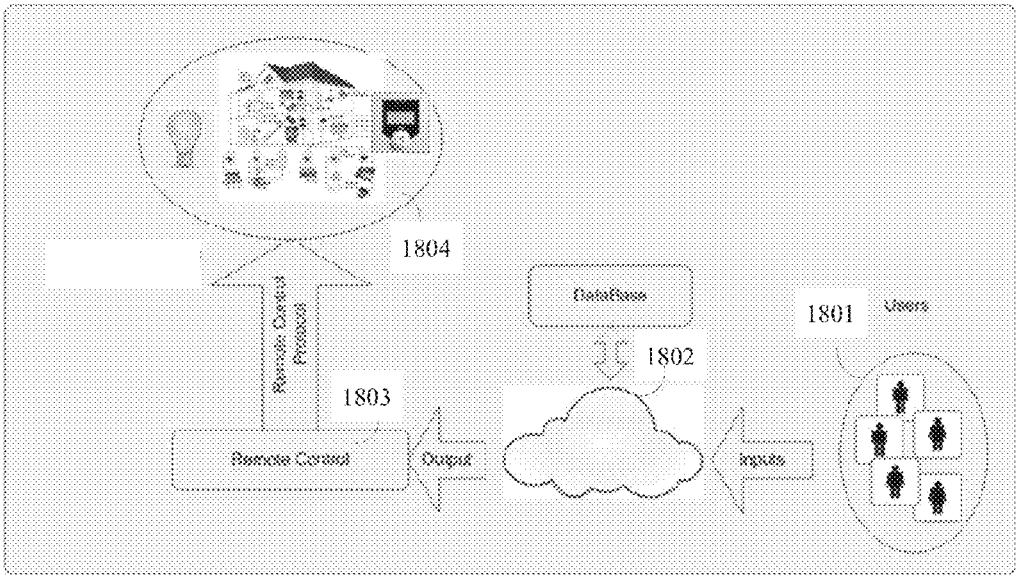
FIG. 18 illustrates a remote control system according to another embodiment of the present patent application.

FIG. 18 illustrates a remote control system according to another embodiment of the present patent application. Referring to FIG. 18, the user input is the command of the users 1801 entering the cloud 1802 via the user's favorite communication platform. The cloud 1802 interprets the command, looks up the protocol from the database (included in the cloud) and sends the control protocol to the remote control device 1803. The remote control device 1803 is a device attached to a master device, which generates the physical communication signal to control the remotely controlled device 1804. The remotely controlled device at home can be TV, entertainment systems, lightings and etc.

Figure 19:
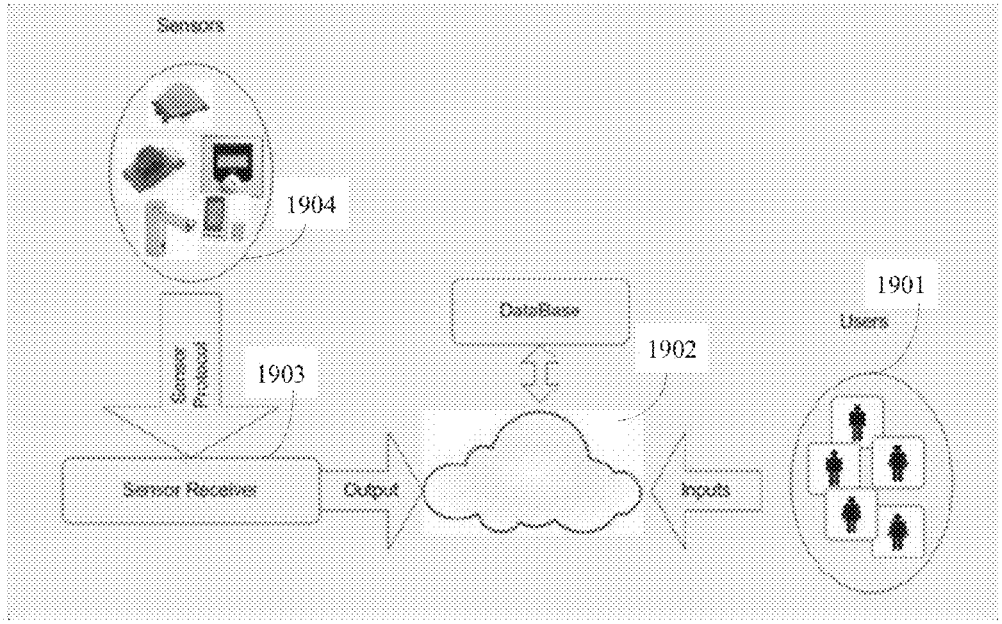
FIG. 19 illustrates a universal sensor system according to another embodiment of the present patent application.

FIG. 19 illustrates a universal sensor system according to another embodiment of the present patent application. Referring to FIG. 19, the user input is the command of the users 1901 entering the cloud 1902 via the user's favorite communication platform to extract the sensor information. The cloud 1902 reads the sensor data and stores it into the database. It also interprets the query command from the users 1901 and returns the requested sensor data. The sensor receiver 1903 is a device attached to a master device, which collects the sensor information via the physical communication protocol and sends the data output of the sensors 1904 to the computing cloud 1902. The sensor 1904 is any wireless/wired device that measures a measurable attribute and converts it into a signal that can be read by the sensor receiver 1903. Examples of the sensor include temperature sensors, CCD cameras, electrical meters, water meters, and etc. It is understood that the sensor receiver 1903 can also be configured as a controller to control the sensors 1904 based on the inputs from the users 1901, which are converted to commands by the computing cloud 1902.

Figure 20:
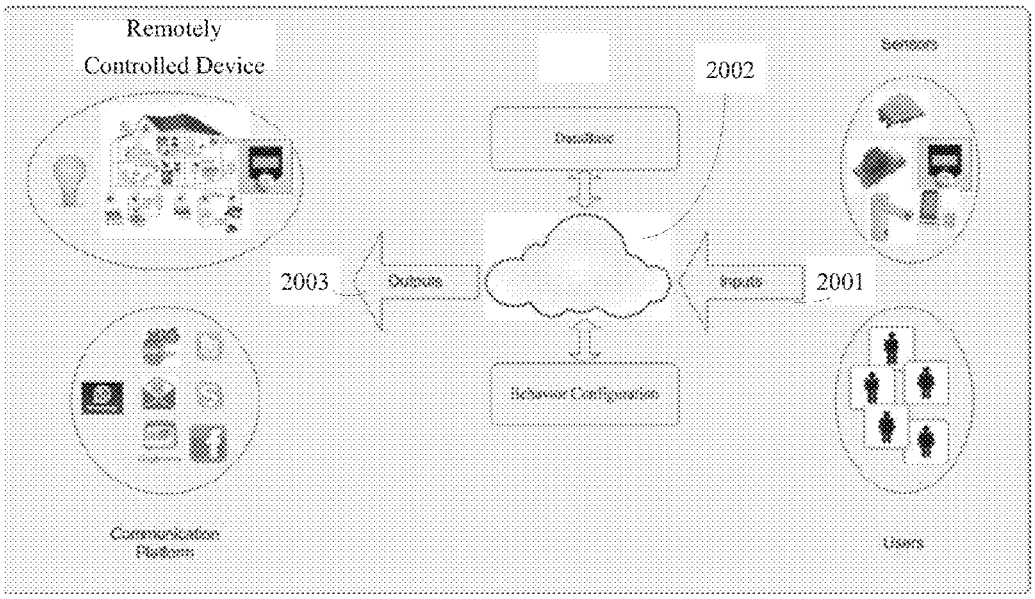
FIG. 20 illustrates a universal home automation system according to another embodiment of the present patent application.

FIG. 20 illustrates a universal home automation system according to another embodiment of the present patent application. Referring to FIG. 20, in this system, the inputs 2001 can be given by users, sensors, and events. The cloud 2002 is configured to take the inputs, process them according to a behavior model, and then generate a command to the outputs 2003. The outputs 2003 go to the remotely controlled device or communication channels that can reach the users.

In above embodiments, the systems can use off-the-shelf applications to control the home device and do not need to have a computer running at home. The protocol between the home controller and the cloud is fixed, which makes the home controller easy and cheap to implement. The cloud provides the user interface instead of the home controller so that adding new interfaces only involve changing the cloud service. The cloud can feed any predefined information to the home controller so that all the intelligence resides at the cloud.

While the present patent application has been shown and described with particular references to a number of embodiments thereof, it should be noted that various other changes or modifications may be made without departing from the scope of the present invention.

What is claimed is:

1. A system for remote control comprising:

a user device configured to run an application that receives a user input;

a remote device comprising a controller and a controlled device; and a computing cloud being connected to the user device and the remote device through the Internet and configured to convert the user input received at the user device to a command;

wherein:

the controller is configured to receive and execute the command and thereby control the controlled device accordingly;

the application is a non-customized application; and the controlled device comprises a plurality of cascadable LED cubes.

2. The system of claim 1, wherein the computing cloud comprises a database configured for storing the user's configuration of the controlled device.

3. The system of claim 2, wherein the computing cloud further comprises a computing service configured for generating the command and transmitting the command to the controller.

4. The system of claim 3, wherein the computing cloud further comprises a set of configuration tools configured for allowing the user to configure the behavior of the controlled device in occurrence of an event.

5. The system of claim 1, wherein the remote device further comprises a gateway configured to enable the communication between the controller and the computing cloud.

6. The system of claim 5, wherein the controller comprises a global master controller being connected to the gateway and a plurality of local master controllers being connected to the global master controller.

7. The system of claim 6, wherein a cascadable LED cube is connected to each local master controller, the LED cube comprising a slave controller and a LED matrix attached to the slave controller.

8. The system of claim 7, wherein the LED matrix comprises a plurality of LED nodes, each LED node comprising a LED chip and a LED capsule.

9. The system of claim 8, wherein the LED capsule is a housing that accommodates the LED chip, the LED capsule comprises a left capsule and a right capsule, and the LED capsule is integrated with the LED chip through a molding process.

10. The system of claim 9, wherein the left capsule comprises a first mechanical feature for making a z-axis connection, a second mechanical feature for holding LED leads, a third mechanical feature for holding the right and left capsules together, and a fourth mechanical feature for making a x or y axis connection.

11. The system of claim 9, wherein the right capsule comprises a first mechanical feature for making a z-axis connection, an electrical connection area, a second mechanical feature for holding LED leads, a third mechanical feature for holding the right and left capsules together, and a fourth mechanical feature for making a x or y axis connection.

12. The system of claim 7, wherein the slave controller is configured to take command from the local master controller and thereby control the LED matrix, and the slave controller contains a unique physical ID and at least one logical ID, the logical ID being dynamically assigned during an initialization process.

13. The system of claim 12, wherein the slave controller comprises a current sensor and the slave controller is configured to determine the configuration of the LED matrix by the readings of the current sensor during an individual LED scanning routine.

14. The system of claim 12, wherein the slave controller further comprises a neighbor explorer IO configured to indicate the presence of the slave controller and to detect the presence of neighboring controllers.

15. The system of claim 1 further comprising a plurality of additional remote devices, wherein all the remote devices are synchronized with a common clock, and the GPS information of all the remote devices are sent to computing cloud.

16. The system of claim 7, wherein the slave controller and the LED matrix are shaped into models of atoms and bonds.

17. A system for remote control comprising:

a user device configured to run an application that receives an input;

a remote device comprising a controller and a controlled device; and a computing cloud being connected to the user device and the remote device through the Internet and configured to convert the user input received at the user device to a command;

wherein:

the controller is configured to receive and execute the command and thereby control the controlled device accordingly; and the application is a non-customized application.

18. The system of claim 17, wherein the computing cloud comprises a database that stores the protocol for the controller to control the controlled device, and the input is given by a user or a sensor.

19. A system for remote control comprising:

a user device configured to run an application that receives a user input;

a remote device comprising a controller and a controlled device; and a computing cloud being connected to the user device and the remote device through the Internet and configured to convert the user input received at the user device to a command;

wherein:

the controller is configured to receive and execute the command and thereby control the controlled device accordingly;

the application is a non-customized application; and the controlled device is a sensor.

20. The system of claim 19, wherein the controller is configured to send the data output of the sensor to the computing cloud.

* * * * *